United States Patent [19]

Heinig

[11] 3,946,579

[45] Mar. 30, 1976

[54] ONE-PIECE PANTY AND METHOD OF MANUFACTURE

[75] Inventor: Richard H. Heinig, Fayetteville, Ark.

[73] Assignee: Bear Brand Hosiery Co., Chicago, Ill.

[22] Filed: Dec. 10, 1973

[21] Appl. No.: 423,072

[52] U.S. Cl. ..... 66/177

[51] Int. Cl.[2] .... A41B 9/02; A41B 9/04; A41B 9/10

[58] Field of Search ..... 66/175, 176, 177, 173, 66/41, 172 E

[56] References Cited

UNITED STATES PATENTS

| | | | |
|---|---|---|---|
| 2,308,121 | 1/1943 | St. Pierre et al. | 66/175 X |
| 2,451,697 | 10/1948 | Speicher | 66/177 |
| 2,953,003 | 9/1960 | Crawford | 66/173 X |
| 3,075,375 | 1/1963 | Garrou et al. | 66/177 |
| 3,487,662 | 1/1970 | Safrit et al. | 66/177 X |
| 3,673,821 | 7/1972 | Johnson | 66/177 |
| 3,720,078 | 3/1973 | Burleson | 66/177 X |

FOREIGN PATENTS OR APPLICATIONS

| | | | |
|---|---|---|---|
| 2,034,010 | 1/1971 | Germany | 66/177 |
| 399,591 | 10/1933 | United Kingdom | 66/176 |
| 2,070,477 | 8/1971 | France | 66/177 |
| 1,800,166 | 4/1970 | Germany | 66/177 |
| 1,809,378 | 6/1970 | Germany | 66/177 |
| 1,900,189 | 7/1970 | Germany | 66/177 |
| 1,935,030 | 1/1971 | Germany | 66/177 |
| 1,958,569 | 8/1970 | Germany | 66/177 |

OTHER PUBLICATIONS

The Hosiery Trade Journal, June, 1973, Vol. 80, No. 954, pp. 99 & 100.

*Primary Examiner*—Ronald Feldbaum

*Attorney, Agent, or Firm*—Prangley, Dithmar, Vogel, Sandler & Stotland

[57] ABSTRACT

A one-piece seamless unidirectional rotary knitted panty having wales and courses therein comprising a seamless tubular body integrally knitted, the body having a waist opening therein intermediate the ends thereof and a crotch portion opposite the waist opening, the ends of the body each having a leg band integrally knitted thereon and turned upon itself and integrally joined with itself to provide a double thickness, the panty comprising a single continuous seamless knitted tube forming the body and the leg bands with all the knitted wales of the leg bands extending through the leg bands into the body and with the knitted courses extending circumferentially of the tube; in another form of the invention an integrally knitted leg is disposed between the body and each leg band; in yet another form of the invention, alternate courses throughout the panty are knitted of elastomeric yarn so as to impart an elastomeric character to the panty throughout the area thereof, thus providing a foundation garment; a novel method of manufacture is also disclosed.

9 Claims, 9 Drawing Figures

ONE-PIECE PANTY AND METHOD OF MANUFACTURE

BACKGROUND OF THE INVENTION

The present invention relates to one-piece seamless panties and the method of manufacturing the same, and specifically to the provision of a panty having a leg band integrally knitted on each end of a tube forming the panty, each leg band being turned upon itself and integrally joined with itself to provide a double thickness.

The standard manner of manufacturing panties heretofore is to provide three panels, a front panel, a back panel and an extra panel which are sewn together, after which two elastic leg bands and an elastic waist band are secured thereto. Such a structure provides seams at the hips and in the crotch area, which seams are bulky and uncomfortable to the wearer.

U.S. Pat. No. 2,736,036 discloses a seamless undergarment or panty knitted as a single piece of tubular knitted fabric, but it was necessary to add a strengthening patch 9 thereto and to fold over and sew around the leg openings as at 8 to provide suitable leg bands and a crotch portion.

U.S. Pat. No. 2,962,884 also shows a seamless undergarment or panty, but it is necessary to have machines with both rotary and reciprocatory knitting capabilities in order to knit the garment. Furthermore, stretch bands 32 and 33 must be separately sewn onto the legs of the blank to complete the panty.

SUMMARY OF THE INVENTION

The present invention provides a one-piece seamless unidirectional rotary knitted panty and the method of manufacturing the same, wherein the panty comprises a single continuous seamless knitted tube forming the body and the leg bands, as well as legs if provided, with all the knitted wales of all parts of the panty extending throughout the panty and with the knitted courses extending circumferentially of the tube.

This is accomplished in the present invention, and it is an object of the present invention to provide a one-piece seamless unidirectional rotary knitted panty having wales and courses therein comprising a seamless tubular body integrally knitted, the body having a waist opening therein intermediate the ends thereof for receiving the lower part of the trunk of the wearer and having a crotch portion opposite the waist opening extending beneath the crotch of the wearer in use, the ends of the body each having a leg band integrally knitted thereon and turned upon itself and integrally joined with itself to provide a double thickness at each of the leg bands, the panty comprising a single continuous seamless knitted tube forming the body and the leg bands with all the knitted wales of the leg bands extending through the leg bands and into the body and with the knitted courses extending circumferentially of the tube.

In connection with the foregoing object, it is another object of the invention to provide a one-piece seamless panty wherein downwardly depending legs are integrally knitted between the body and the leg bands, the panty comprising a single continuous seamless knitted tube forming the body and the legs and the leg bands with all the knitted wales of the leg bands and the legs extending through the leg bands and the legs into the body and with the knitted courses extending circumferentially of the tube.

Another object of the invention is to provide a one-piece seamless panty of the type set forth wherein the leg bands are knitted with at least certain courses therein of elastomeric yarn so as to impart an elastic character to the leg bands.

Yet another object of the invention is to provide a one-piece seamless panty of the type set forth wherein the waist opening is provided by a walewise extending interruption in the tubular form of the body, and further includes an elastic waist band secured to the body and encircling the waist opening.

Still another object of the invention is to provide a one-piece seamless panty of the type set forth wherein the crotch portion is 1X1 tuck float knitted to provide a dense relatively stretchless material.

Yet another object of the invention is to provide a one-piece seamless panty of the type set forth wherein a side panel is provided adjacent to the crotch portion and disposed toward the waist opening on each side of the crotch portion, the crotch portion being 1X1 tuck float knitted to provide a dense relatively stretchless material, the side panels being 1X1 tuck knitted to provide a material intermediate in density and stretchness between the crotch portion and the balance of the body.

A further object of the invention is to provide a one-piece seamless panty of the type set forth wherein at least certain of the knitted courses throughout the tube including the leg bands and the legs and the body are knit of elastomeric yarn so as to impart an elastic character to the panty throughout the area thereof, thus providing a foundation garment, the elastomeric yarn preferably being knit into alternate courses throughout the tube.

A still further object of the invention is to provide the method of manufacture of the one-piece seamless panties set forth herein.

Further features of the invention pertain to the particular arrangement of the parts of the panty and the method of manufacture thereof, whereby the above outlined and additional operating features thereof are attained.

The invention, both as to its organization and method of operation, together with further features and advantages thereof will best understood with reference to the following specification taken in connection with the accompanying drawings.

DESCRIPTION OF THE PREFERRED EMBODIMENTS

Figure 1:
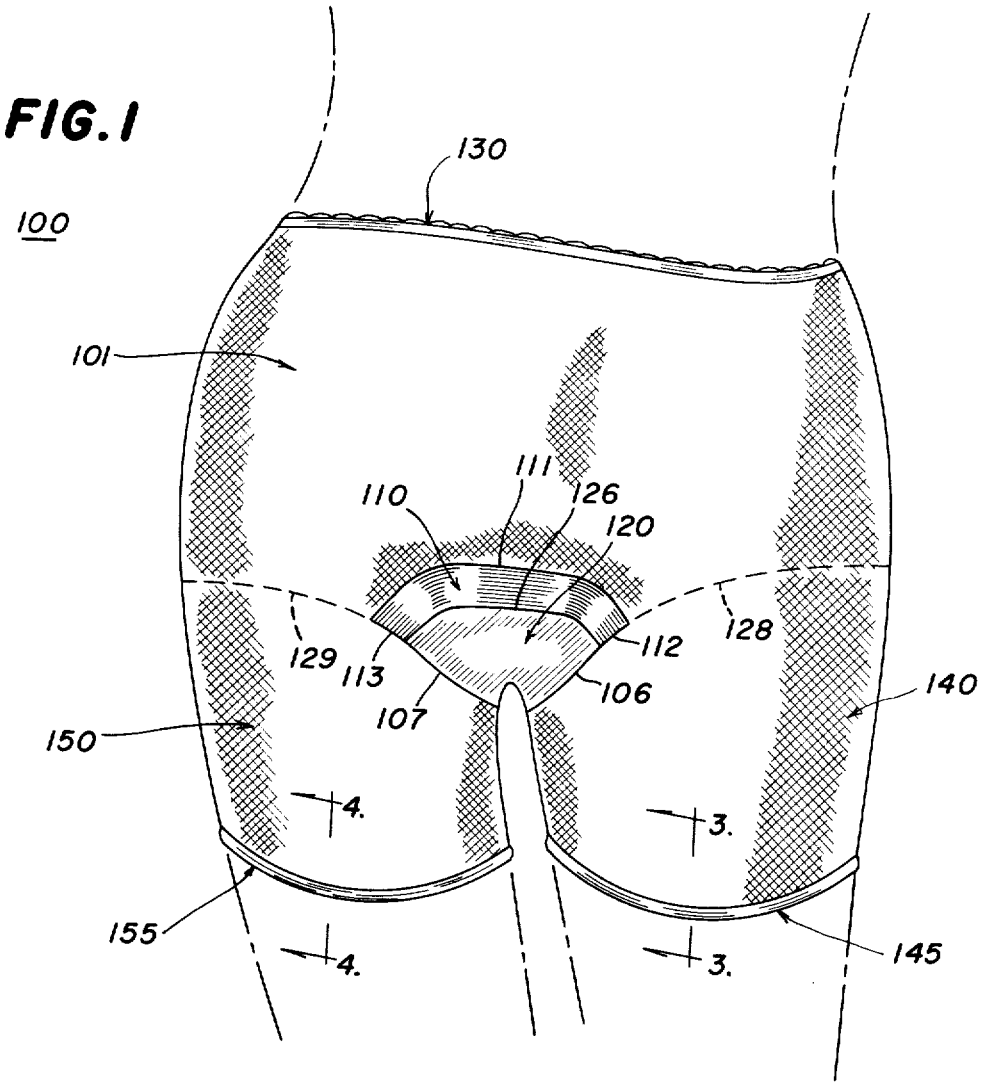
FIG. 1 is a perspective view of a first embodiment of a one-piece seamless panty made in accordance with and embodying the principles of the present invention, the panty being shown in position on a wearer.
Figure 2:
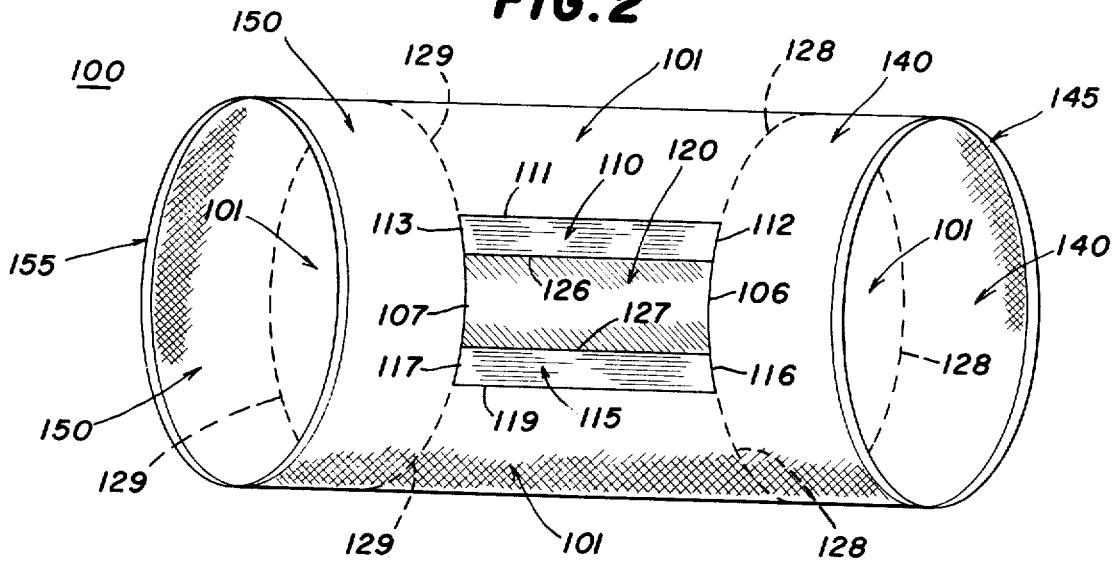
FIG. 2 is an elevational view of the panty of FIG. 1 as viewed toward the crotch portion thereof.
Figure 5:
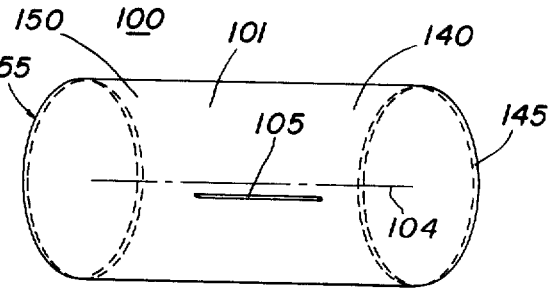
FIG. 5 is a diagrammatic view of the knitted tube as viewed from the waist opening side.

Referring to FIGS. 1 to 5 of the drawings, there is illustrated a first embodiment of a one-piece seamless panty 100 made in accordance with and embodying the principles of the present invention, the panty 100 including a body 101, a front side panel 110, a rear side panel 115, a crotch portion 120, a waist band 130, a first leg 140 and a second leg 150, the first leg 140 carrying an integral leg band 145 and the second leg 150 carrying an integral leg band 155. The panty 100 is knit as a single continuous seamless tube using a unidirectional rotary knitting method and is continually knit starting with the leg band 145 and proceeding through the leg 140, the body 101, the leg 150 and the leg band 155 in a continuous uninterrupted manner. As a result, all of the knitting wales in the leg band 145 and the leg 140 extend therethrough and into the body 101 and then into the leg 150 and the leg band 155, the knitted courses extending circumferentially of the tube as illustrated in FIGS. 2 and 5.

The knitted tube has a slit 105 therein extending longitudinally thereof, the slit 105 being on the side of the tube opposite the crotch portion 120 but offset from the center line 104 of the tube which is directly opposite the center of the crotch portion, all for a purpose to be described more fully hereinafter. Secured to the body 101 and encircling the waist opening provided by the slit 105 is the waist band 130 that is elastic in character and which is secured to the body 101 in any suitable manner such as by sewing. The slit 105 is actually disposed from the center line 104 toward the front side panel 110 so as to provide more material in the rear of the panty 100 and less in the front so as to provide a better fit on the wearer.

The front side panel 110 and the rear side panel 115 are integrally knit in the body 101 as is the crotch portion 120, the side panels 110 and 115 and the crotch portion 120, and each may have a length corresponding to the same number of knitted courses in the tube forming the panty 100. The front side panel 110 is integrally knitted with the balance of the body 101 and joins the same along the juncture 111 and integrally joins the legs 140 and 150 along junctures 112 and 113, respectively. The rear side panel 115 likewise is integrally knitted and joins the body 101 along the juncture 119 and integrally joins the legs 140 and 150 at junctures 116 and 117, respectively. The crotch portion 120 likewise is integrally knitted with the side panels 110 and 115 and with the legs 140 and 150, the crotch portion 120 integrally joining the side panels 110 and 115 along junctures 126 and 127, respectively, and integrally joining the legs 140 and 150 along junctures 106 and 107. The legs 140 and 150 are likewise integrally knitted with the body 101 and join the body 101 along courses 128 and 129, respectively, these courses in effect providing junctures between the several parts.

Figure 3:
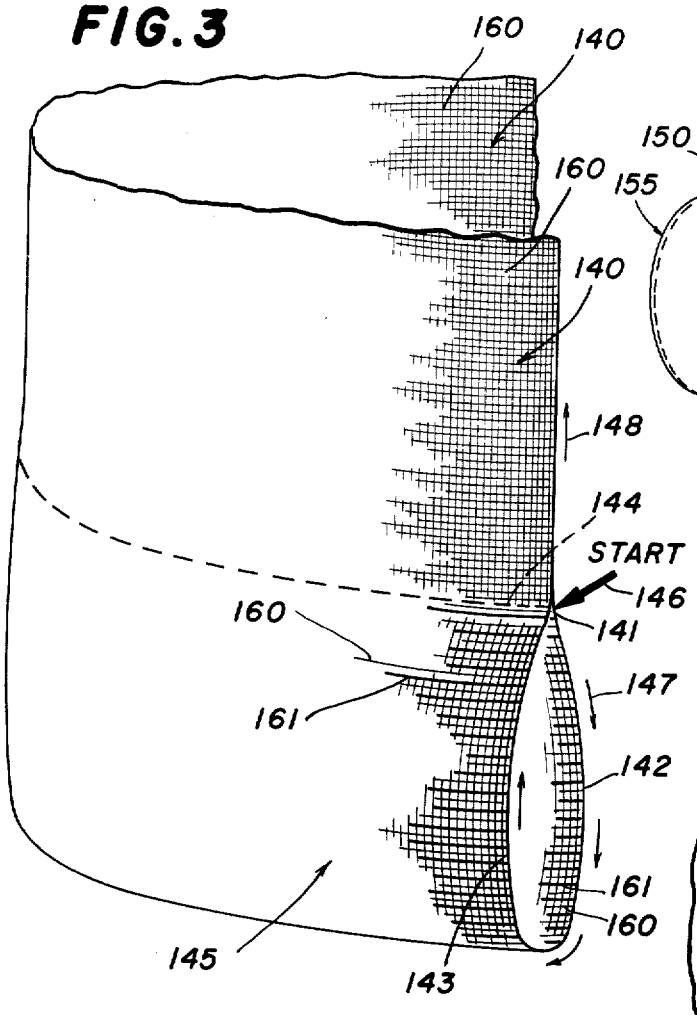
FIG. 3 is a fragmentary enlarged view in section along the line 3—3 of FIG. 1 and illustrating one leg band.

Referring to FIG. 3 the details of construction of the leg band 145 integral with the leg 140 are shown. The garment actually is knitted beginning at 141 which is the make-up for the panty 100, as illustrated by the arrow 146 labelled "START". Integral with the make-up 141 is an inside band portion 142 that is integral with an outside band portion 143, the band portions 142 and 143 being joined at the juncture 144, as will be described more fully hereinafter, to provide the completed leg band 145. As illustrated, alternate courses in the leg band 145 are knitted of stretch yarn 160 and the remaining courses knitted of elastomeric yarn 161 so as to impart an elastic character to the leg band 145, thus improving the fit thereof about the thigh of the wearer.

Figure 4:
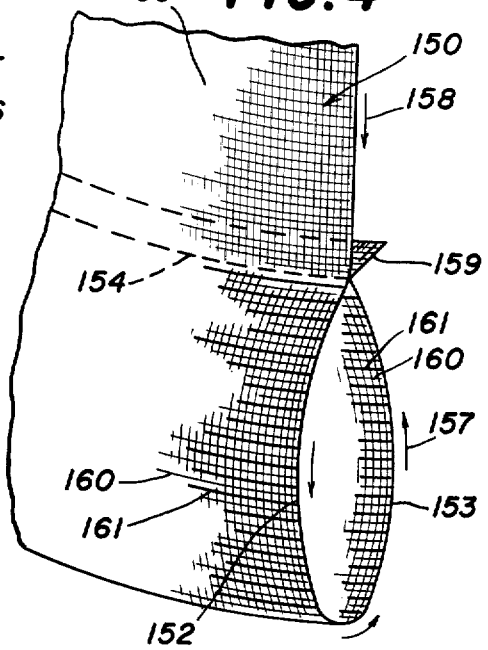
FIG. 4 is a fragmentary enlarged view in cross section along the line 4—4 of FIG. 1 and illustrating the other leg band.

Referring to FIG. 4 of the drawings, the details of construction of the leg band 155 are shown. Integral with the leg 150 is an outside band portion 152 that in turn is integral with an inside band portion 153, the band portions 152 and 153 being knit together as at the juncture 154. Also integral with the juncture 154 is a selvage 159 which is the last portion of the panty 100 to be knitted. The leg band 155 also has alternate courses knitted of stretch yarn 160 and the remaining courses knitted of elastomeric yarn 161 so as to impart an elastic character to the leg band 155.

All of the body 101, the side panels 110 and 115, the crotch portion 120 and the legs 140 and 150 are illustrated as being knit of stretch yarn, as well as the alternate courses of the leg bands 145 and 155. A "stretch yarn" is made from thermoplastic fiber or fibers, usually in continuous filament form, which is capable of a pronounced degree of elongation and a rapid recovery, this property being obtained by having the yarn subjected to an appropriate combination of deforming, heat setting, and developing treatments, this including crimped yarn, torque yarn and non-torque yarn. Suitable materials for such stretch yarn are nylon, polypropylene, and polyester resins. Such yarn may be from 40 denier to 70 denier and may comprise from 10 filaments to 34 filaments, the yarn preferably being of the S and Z twist type. A preferred yarn is 50 denier, 17 filament S and Z twist yarn. Such yarn is tumbled at 180° F. and set in the dye bath at approximately 212° F. An "elastomeric yarn" is a yarn made from an elastic material such as polyurethane or rubber. The denier of the elastomeric yarn is preferably in the range from 20 to 140, the preferred material being 70 denier. Such yarn is also preferably single wrapped or double wrapped with nylon of 20 to 40 denier and containing 7 to 13 filaments. A preferred elastomeric yarn is a spandex 70 denier single wrapped with 30 denier, 10 filament, nylon. Examples of such yarns are offered under the trademarks "Unel", "Lycra" and "Glo-Span". Also useful are the nylon-polyurethane combination filaments such as that sold under the trademark "Monvelle".

The panty 100 is preferably knit upon an 8-feed rotary knitting machine such as an 8-feed "Zodiac Fantasia" machine manufactured by the Billi Company of Italy. In the one preferred form of such machine, 400 or more knitting needles are provided as well as a dial for make-up. The following is a description of the knitting of the panty 100 using such an 8-feed machine and wherein the stretch yarn 160 is a 50 denier, 17 filament, S and Z twist yarn, and the elastomeric spandex yarn 161 is a 70 denier single wrapped with 30 denier, 10 filament, nylon.

Make-up is begun with every other loop on a dial transfer jack and knitting the stretch yarn 160 and the elastomeric yarn 161 into alternate courses i.e., referring to FIG. 3, a first course, for example, is knitted of stretch yarn 160, the second course is knitted of elastomeric yarn 161, the third course is knitted of stretch yarn 160, the fourth course is knitted of elastomeric yarn 161, etc. Referring to FIG. 3, make-up begins at the point 141 and knitting continues with every other loop on a dial transfer jack downwardly along the inside band portion 142 in the direction of the arrow 147 and then upwardly along the outside band portion 143 to the juncture 144. At the juncture 144 the knitted fabric is transferred off of the dial jacks onto the balance of the needles and the elastomeric yarn 161 is replaced by stretch yarn 160. As a result, the leg band 145 is knitted integrally and turned upon itself and integrally joined with itself at the juncture 144 to provide a double thickness, alternate courses being formed of the stretch yarn 160 and the remaining courses being formed of the elastomeric yarn 161.

With all the loops now on the knitting needles, and with stretch yarn 160 fed to all knitting stations, knitting proceeds along the first leg 140 in the direction of the arrow 148 in FIG. 3 and toward the juncture designated by the numeral 128 in FIG. 1. When all the courses have been knitted to the course at the juncture 128, the first leg 140 is complete, and the machine is then adjusted automatically without interruption to knit the body 101. The leg 140 and the bulk of the body 101 is preferably knit as a 1 × 1 knit and tuck on every other needle on every other feed, all needles in action, the leg 140 being relatively tightly knit while the bulk of the body 101 is relatively loosely knit.

The body 101 is also knit entirely of stretch yarn 160, but the character of the knitting is changed in the side panels 110 and 115 and in the crotch portion 120. In one preferred form of the body 101, the main portion thereof is knitted as described immediately above, namely, a 1 × 1 knit and tuck on every other needle on every other feed, all needles in action with all needles knitting plain stitches at intervening feeds. The side panels 110 and 115 are knit 1 × 1 tuck knit with alternate needles tucking on feeds 2, 4, and 8 and intervening needles knitting plain stitches and clearing all stitches to form plain stitches on feed 6; feeds 1, 3, 5 and 7 are tucking on intervening needles, and the alternate needles welt to form floats. 3, 5, and 7 and tucking on feeds 2, 4, 6 and 8, and knitting and clearing every third revolution on feed 6.

The manner chosen to knit the crotch portion 120 should result in a very dense and relatively stretchless fabric which provides a reinforced area in the body 101. For example, the crotch 120 could be knit in a tuck stitch pattern wherein each tuck stitch included plural tuck loops. The side panels 110 and 115 are also more dense than the fabric in the legs 140 and the bulk of the body 101, but less dense than the fabric in the crotch portion 120. The side panels 110 and 115 are also less stretchable than the fabric of the leg 140 and the bulk of the body 101, but more stretchable than the fabric in the crotch portion 120. The fabric in the body 101 above the junctures 111 and 119 is relatively loosely knitted and quite stretchable to permit fitting of the panty 100 to the wearer. It is also pointed out that the fabric in the body 101 above the junctures 111 and 119 is relatively more loosely knit as compared to the fabric in the leg 140 which is relatively tightly knit. More specifically, the 1 × 1 tuck stitch in the body 101 above the junctures 111 and 119 forces more yarn into the fabric resulting in a more bulky fabric, giving a higher rise because of more cross stretch, i.e. more stretch in a direction from the junctures 111 and 119 toward the waist band 130.

In a second preferred form of the body 101 a different knitting pattern is utilized in the side panels 110 and 115 and in the crotch portion 120. More specifically, the side panels 110 and 115 are knit as a 1 × 1 tuck stitch on feeds 2, 3, 4, 5, 6, 7 and 8, i.e., every other needle is knitting and the alternate needles are tucking and clearing, all clearing and knitting plain stitches at feed 1,. The crotch 120 is 1 × 1 tuck knit at feeds 2, 3, 4, 5, 6, 7 and 8 wherein every other needle is knitting and the alternate needles are tucking, and with all needles clearing and tucking plain stitches at feed 1 at every other revolution and with feed 1 tucking alternate needles and forming plain stitches on every other needle at intervening revolutions.

The knitting of the body 101 proceeds from the course at the juncture 128 completely through the body 101 to the course illustrated by the juncture 129. As a consequence, the side panels 110 and 115 and the crotch portion 120 all contain the same number of courses. However, because of the different character of the fabric knit, the area of the crotch portion 120 is relatively smaller than the balance of the body 101, this serving the additional purpose of shaping the garment in a desirable manner.

When knitting has proceeded to the course represented by the juncture 129, the needles in the feeds are again adjusted so as to knit relatively more tightly and to produce the leg 150. Referring to FIG. 4, knitting proceeds down leg 150 as indicated by the arrow 158 until the juncture 154 is reached. At that point, every other loop is fed onto a dial transfer jack and the elastomeric yarn 161 is fed into every other course. The outside band 152 is knit following the arrows 157 after which the inside band 153 is knit back to the juncture 154. At the juncture 154 the material is transferred off of the dial transfer jacks onto the needles, after which a short selvage 159 is knit. As a result of this knitting action, an integral seamless leg band 155 is produced that is turned upon itself and integrally joined with itself at the juncture 154 to provide a double thickness. The provision of the elastomeric yarn 161 in alternate loops renders the leg band 155 elastic in character to provide a good fit on the leg of the wearer.

When knitting of the selvage 159 begins, to preferably the feeds are reduced from eight in number to four in number so as to minimize the amount of selvage generated. It is also desirable to insert in one feed a lower melting point yarn which will fuse at the dye bath temperature to prevent raveling of the fabric at the selvage 159.

In the "Zodiac Fantasia" knitting machine described above there is provided a hot wire mechanism for automatically forming the slit 105 as the body 101 is knit, the hot wire also fusing the cut ends of the fabric so as to minimize raveling thereof. It will be understood that other methods of forming the slit 105 may be used including a scissors or knife arrangement on the knitting machine or a slitting of the body 101 after completion of the knitting thereof. The slit 105 is a walewise extending interruption in the tubular body 101 and is disposed forwardly with respect to the center line 104 in FIG. 5 for the reasons described above. The elastic waist band 130 is secured to the body 101 and encircling the slit 105 as has been described.

The panty 100 is preferably subjected, in the greige and before attachment of the waist band 130, to a relaxing treatment effected under the action of heat and moisture which develops the stretch qualities of the stretch yarn 160 and enhances the capacity of the panty 100, and particularly the body 101 and the legs 140 and 150, for elastic stretch and recovery. This can be accomplished by tumbling at 180° F. or may be combined with a dyeing treatment, the yarn being set in the dye bath at about 212° F.

Figure 6:
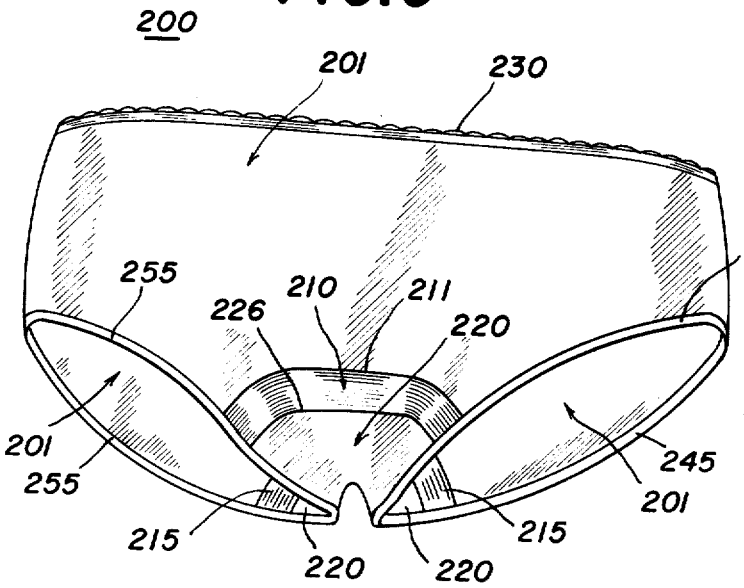
FIG. 6 is a perspective view of a second form of one-piece seamless panty made in accordance with and embodying the principles of the present invention, the panty of FIG. 6 having no separate legs disposed between the body and the leg bands.
Figure 7:
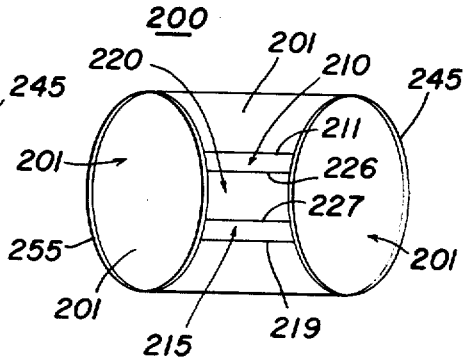
FIG. 7 is a bottom view of the panty of FIG. 6.

Referring now to FIGS. 6 and 7 of the drawings, there is illustrated a second embodiment of a one-piece seamless panty 200, the panty 200 being of the panty brief or bikini style. The panty 200 is identical in construction to the panty 100, except that there are no legs, such as the legs 140 and 150 of the panty 100, provided therein. Accordingly, like parts of the panty 200 that correspond to like parts in the panty 100 have had numerals in the 200 series corresponding to the numerals in the 100 series applied thereto to indicate the identity in construction of the like parts. More particularly, the panty 200 includes a body 201, a front side panel 210, a rear side panel 215, a crotch portion 220, a waist band 230, a leg band 245 and a leg band 255. The panty 200 is knit as a single continuous seamless tube using a unidirectional rotary knitting method and is continually knit starting with the leg band 245 and proceeding through the body 201 and the leg band 255 in a continuous uninterrupted manner. As a result, all of the knitting wales in the leg band 245 extend therethrough and into the body 201 and then into the leg band 255, the knitted courses extending circumferentially of the tube as illustrated in FIG. 7.

The knitted tube has a slit (not shown) therein extending longitudinally thereof like the slit 105 described above on the side of the tube opposite the crotch portion 220. Secured to the body 201 and encircling the waist opening provided by the slit therein is the waist band 230 that is elastomeric in character and which is secured to the body 201 in any suitable manner such as by sewing.

The front side panel 210 and the rear side panel 215 are integrally knitted in the body 201 as is the crotch portion 220, the side panels 210 and 215 and the crotch portion 220 and each may have a length corresponding to the same number of knitted courses in the tube forming the panty 200. The front side panel 210 is integrally knitted with the balance of the body 201 and joins the same along the juncture 211. The rear side panel 215 likewise is integrally knitted and joins the body 201 along the juncture 219. The crotch portion 220 likewise is integrally knitted with the side panels 210 and 215, the crotch portion 220 integrally joining the side panels 210 and 215 along junctures 226 and 227, respectively.

All of the body 201, the side panels 210 and 215, and the crotch portion 220 are illustrated as being knitted of stretch yarn as are the alternate courses of the leg bands 245 and 255. The other courses of the leg bands 245 and 255 are knitted of elastomeric yarn, thereby to impart an elastic character to the leg bands 245 and 255 to improve the fit thereof with the wearer. As in the panty 100 described above, so also in the panty 200 the crotch portion 220 is a very dense and relatively stretchless fabric which provides a reinforced area in the body 201. The side panels 210 and 215 are also more dense than the fabric in the bulk of the body 201, but less dense than the fabric in the crotch portion 220. The side panels 210 and 215 are also less stretchable than the fabric in the bulk of the body 201, but more stretchable than the fabric in the crotch portion 120. The fabric in the body 201 above the junctures 211 and 219 is relatively loosely knitted and quite stretchable to permit fitting of the panty 200 to the wearer.

The knitting of the paney 200 is performed in substantially the same manner as the knitting of the panty 100, except that no legs 140 and 150 are knitted. More specifically, the make-up is begun on the inside portion of the leg band 245 and proceeds around the leg band 245 and then into the body 201 and then onto the outside portion of the leg band 255 and then to the inside of the leg 255 and terminating in a selvage (not shown). The types of stitches and the yarns used in the panty 200 may, for example, be the same as those used in like parts in the panty 100 described above.

Figure 8:
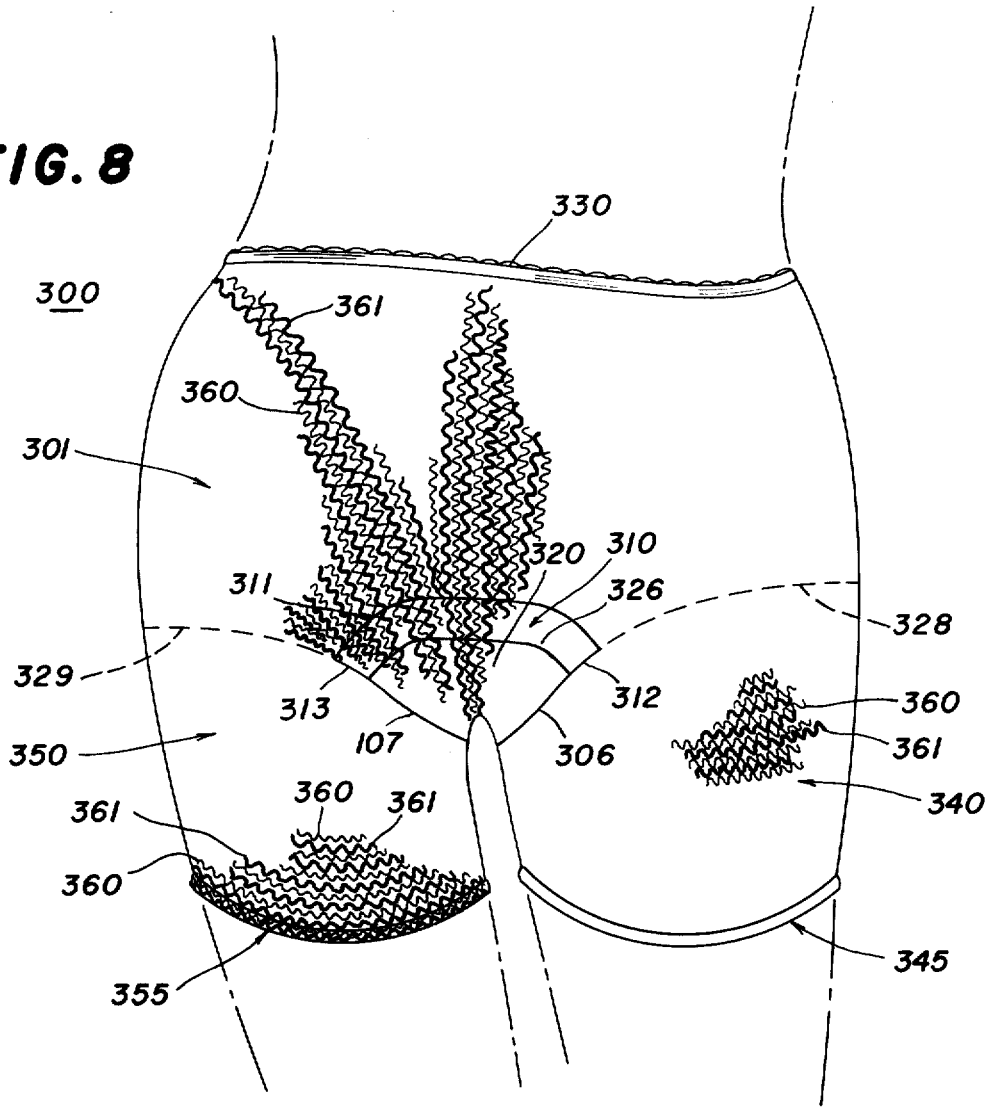
FIG. 8 is a perspective view of a third embodiment of a one-piece seamless panty made in accordance with and embodying the principles of the present invention, this panty having elastomeric yarn knit throughout to provide a foundation garment.
Figure 9:
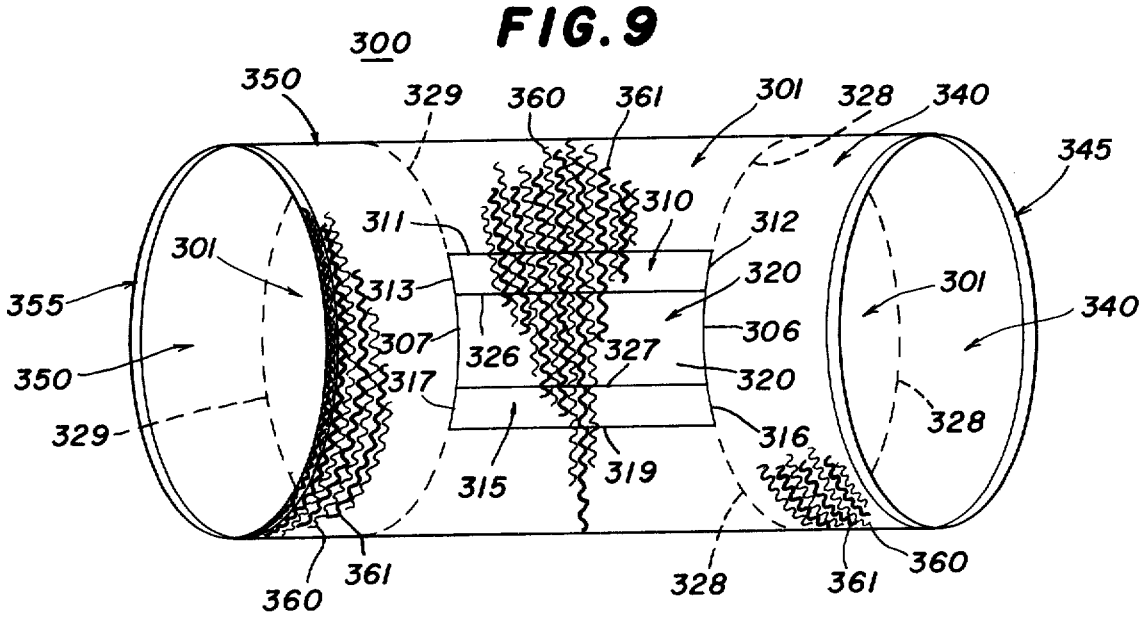
FIG. 9 is a bottom view of the panty of FIG. 8.

Referring to FIGS. 8 and 9 of the drawings, there is illustrated a third embodiment of a one-piece seamless panty 300 made in accordance with and embodying the principles of the present invention. The panty 300 is identical in construction to the panty 100 except that alternate courses are knitted of stretch yarn 360 and the remaining courses knitted of elastomeric yarn 361 throughout the body of the panty 300. Accordingly, like parts of the panty 300 that correspond to like parts in the panty 100 have had numerals in the 300 series corresponding to the numerals in the 100 series applied thereto to indicate the identity in construction of the like parts. The panty 300 includes a body 301, a front side panel 310, a rear side panel 315, a crotch portion 320, a waist band 330, a first leg 340 and a second leg 350, the first leg 340 carrying an integral leg band 345 and the second leg 350 carrying an integral leg band 355. The panty 300 is knit as a single continuous seamless tube using a unidirectional rotary knitting method and is continually knit starting with the leg band 345 and proceeding through the leg 340, the body 301, the leg 350 and the leg band 355 in a continuous uninterrupted manner. As a result, all of the knitting wales in the leg band 345 and the leg 340 extend therethrough and into the body 301 and then into the leg 350 and the leg band 355, the knitted courses extending circumferentially of the tube as illustrated in FIG. 9.

The knitted tube has a slit therein extending longitudinally thereof like the slit 105 described above. Secured to the body 301 and encircling the waist opening provided by the slit is the waist band 330 that is elastic in character and which is secured to the body 301 in any suitable manner such as by sewing.

The front side panel 310 and the rear side panel 315 are integrally knit in the body 301 as is the crotch portion 320, the side panels 310 and 315 and the crotch portion 320 and each may have a length corresponding to the same number of knitted courses in the tube forming the panty 300. The front side panel 310 is integrally knitted with the balance of the body 301 and joins the same along the juncture 311 and integrally joins the legs 340 and 350 along junctures 312 and 313, respectively. The rear side panel 315 likewise is integrally knitted and joins the body 301 along the juncture 319 and integrally joins the legs 340 and 350 at junctures 316 and 317, respectively. The crotch portion 320 also is integrally knitted with the side panels 310 and 315 and with the legs 340 and 350, the crotch portion 320 integrally joining the side panels 310 and 315 along junctures 326 and 327, respectively, and integrally joining the legs 340 and 350 along junctures 306 and 307, respectively. The legs 340 and 350 are likewise integrally knitted with the body 301 and join the body 301 along courses 328 and 329, respectively, these courses in effect providing junctures between the several parts.

All of the body 301, the side panels 310 and 315, and the crotch portion 320 are illustrated as being knitted with alternate courses of stretch yarn 360 and the remaining courses knitted of elastomeric yarn 361 throughout the panty 300. As a result, the panty 300 has a substantial elastic character and therefore serves as a foundation garment.

As in the panties 100 and 200 described above, so also in the panty 300 the crotch portion 320 is a very dense and relatively stretchless fabric which provides a reinforced area in the body 301. The side panels 310 and 315 are also more dense than the fabric in the bulk of the body 301, but less dense than the fabric in the crotch portion 320. The side panels 310 and 315 are also less stretchable than the fabric in the bulk of the body 301, but more stretchable than the fabric in the crotch portion 320. The fabric in the body 301 above the junctures 311 and 319 is relatively loosely knitted and quite stretchable to permit fitting of the panty 300 to the wearer.

The knitting of the panty 300 is performed in substantially the same manner as the panty 100, except that elastomeric yarn 361 is knitted into alternate courses throughout the panty 300. The make-up is begun on the inside portion of the leg band 345 and proceeds around the leg 345 and then into the leg 340 and from there to the body 301; from the body 301 knitting continues into the leg 350 and then onto the outside portion of the leg band 355 and then to the inside of the leg 355 and terminating in a selvage (not shown). The types of stitches used in the panty 300 may, for example, be the same as those used in like parts in the panty 100 described above.

While there have been described what are at present considered to be the preferred embodiments of the invention, it will be undersood that various modifications may be made therein, and it is intended to cover in the appended claims all such modifications as fall within the true spirit and scope of the invention.

What is claimed is:

1. A one-piece seamless unidirectional rotary knitted panty having wales and courses therein comprising a seamless tubular body integrally knitted, said body having a waist opening therein intermediate the ends thereof for receiving the lower part of the trunk of the wearer and having a crotch portion opposite said waist opening extending beneath the crotch of the wearer in use, said crotch portion being knit with a density substantially greater than that of the surrounding areas and being relatively stretchless to provide a reinforced area in said body, said seamless body having seamless downwardly depending legs integrally knit therewith on the ends thereof, the ends of each of said legs having integrally knitted thereon a seamless leg band turned upon itself and integrally knitted with itself to provide a double thickness at each of said leg bands, said body in the portions other than said crotch and said legs and said leg bands being knit with a tuck knit pattern, said leg bands being knitted with at least certain of the courses therein of elastomeric yarn so as to impart an elastic character to said leg bands, one of said leg bands being integrally knit at the make up end of said body and the other of said leg bands being integrally knit at the run off end of said body, said panty comprising a single continuous seamless knitted tube forming the body and the legs and the leg bands with all the knitted wales of said leg bands and said legs extending through said leg bands and said legs into said body and with the knitted courses extending circumferentially of said tube.

2. The panty set forth in claim 1, wherein said legs and said body are knitted with stretch yarn, and said leg bands are knitted with every other course containing elastomeric yarn.

3. The panty set forth in claim 1, wherein the waist opening is provided by a walewise extending interruption in the tubular form of the body, and further including an elastic waist band secured to said body and encircling the waist opening.

4. A one-piece seamless unidirectional rotary knitted panty having wales and courses therein comprising a seamless tubular body integrally knitted, said body having a waist opening therein intermediate the ends thereof for receiving the lower part of the trunk of the wearer and having a crotch portion opposite said waist opening extending beneath the crotch of the wearer in use, said crotch portion being knit with a density substantially greater than that of the surrounding areas and being relatively stretchless to provide a reinforced area in said body, the ends of said body each having a leg band integrally knitted thereon and turned upon itself and integrally knitted with itself to provide a double thickness at each of said leg bands, said body in the portions other than said crotch and said leg bands being knit with a tuck knit pattern, said leg bands being knitted with at least certain of the courses therein of elastomeric yarn so as to impart an elastic character to said leg bands, one of said leg bands being integrally knit at the make up end of said body and the other of said leg bands being integrally knit at the run off end of said body, said panty comprising a single continuous seamless knitted tube forming the body and the leg bands with all the knitted wales of said leg bands extending through said leg bands into said body and with the knitted courses extending circumferentially of said tube.

5. The panty set forth in claim 4, wherein said body is knitted with stretch yarn, and said leg bands are knitted with every other course containing elastomeric yarn.

6. The panty set forth in claim 4, wherein the waist opening is provided by a walewise extending interruption in the tubular form of the body, and further including an elastic waist band secured to said body and encircling the waist opening.

7. A one-piece seamless unidirectional rotary knitted panty having wales and courses therein comprising a seamless tubular body integrally knitted, said body having a waist opening therein intermediate the ends thereof for receiving the lower part of the trunk of the wearer and having a crotch portion opposite said waist opening extending beneath the crotch of the wearer in use, said crotch portion being knit with a density substantially greater than that of the surrounding areas and being relatively stretchless to provide a reinforced area in said body, said seamless body having seamless downwardly depending legs integrally knit therewith on the ends thereof, the ends of each of said legs having integrally knitted thereon a seamless leg band turned upon itself and integrally knitted with itself to provide a double thickness at each of said leg bands, said body in the portions other than said crotch and said legs and said leg bands being knit with a tuck knit pattern, said leg bands being knitted with at least certain of the courses therein of elastomeric yarn so as to impart an elastic character to said leg bands, one of said leg bands being integrally knit at the make up end of said body and the other of said leg bands being integrally knit at the run off end of said body, said panty comprising a single continuous seamless knitted tube forming the body and the legs and the leg bands with all the knitted wales of said leg bands and said legs extending through said leg bands and said legs into said body and with the knitted courses extending circumferentially of said tube, at least certain of said knitted courses throughout said tube including said leg bands and said legs and said body being knit of elastomeric yarn so as to impart an elastic character to said panty throughout the area thereof.

8. The panty set forth in claim 7, wherein alternate courses in said body and said legs and said leg bands are knitted of elastomeric yarn.

9. The panty set forth in claim 7, wherein the waist opening is provided by a walewise extending interruption in the tubular form of the body, and further including an elastic waist band secured to said body and encircling the waist opening.

* * * * *

UNITED STATES PATENT AND TRADEMARK OFFICE

CERTIFICATE OF CORRECTION

PATENT NO. : 3,946,579

DATED : Mar. 30, 1976

INVENTOR(S) : Richard H. Heinig

It is certified that error appears in the above-identified patent and that said Letters Patent are hereby corrected as shown below:

[56] References Cited, United States Patents, insert --3,815,385 6/1974 Gariboldi 66/177xR--

Foreign Patents or Applications, insert --1,246,499 9/1971 Great Britain 66/176, 1/320,047 6/1973 Great Britain 66/176--

Other Publications insert --Translation of German Offenlegungsschrift No. 1,809,378--

Column 5, line 48, after "floats." delete "3, 5, and 7 and tucking on feeds 2, 4, 6 and 8, and knitting and clearing every third revolution on feed 6."

Column 6, line 50, after "begins," delete "to"

Column 8, line 9, "paney" should be --panty--

Signed and Sealed this

*fifteenth* Day of *June 1976*

[SEAL]

*Attest:*

RUTH C. MASON
*Attesting Officer*

C. MARSHALL DANN
*Commissioner of Patents and Trademarks*